US011592022B2

(12) United States Patent
Iijima et al.

(10) Patent No.: US 11,592,022 B2
(45) Date of Patent: Feb. 28, 2023

(54) SCROLL COMPRESSOR AND REFRIGERATION CYCLE DEVICE

(71) Applicant: Hitachi-Johnson Controls Air Conditioning, Inc., Tokyo (JP)

(72) Inventors: Ryota Iijima, Tokyo (JP); Kazuyuki Matsunaga, Tokyo (JP)

(73) Assignee: HITACHI-JOHNSON CONTROLS AIR CONDITIONING, INC., Tokyo (JP)

( * ) Notice: Subject to any disclaimer, the term of this patent is extended or adjusted under 35 U.S.C. 154(b) by 94 days.

(21) Appl. No.: 17/159,308

(22) Filed: Jan. 27, 2021

(65) Prior Publication Data

US 2021/0381508 A1 Dec. 9, 2021

(30) Foreign Application Priority Data

Jun. 8, 2020 (JP) ..... JP2020-099518

(51) Int. Cl.
*F04C 18/02* (2006.01)
*F04C 29/02* (2006.01)
*F04C 23/00* (2006.01)

(52) U.S. Cl.
CPC ..... *F04C 18/0215* (2013.01); *F04C 18/0253* (2013.01); *F04C 23/008* (2013.01); *F04C 29/023* (2013.01); *F04C 29/028* (2013.01)

(58) Field of Classification Search
CPC ..... F04C 18/0207–0292; F04C 29/02; F04C 29/023; F04C 29/028
See application file for complete search history.

(56) References Cited

U.S. PATENT DOCUMENTS 5,370,513 A * 12/1994 Fain ..... F04C 18/0215 418/94
5,395,224 A * 3/1995 Caillat ..... F04C 18/0215 418/94
6,074,186 A * 6/2000 Lifson ..... F04C 29/028 418/55.6
11,221,009 B2 * 1/2022 Uekawa ..... F25B 1/047
2004/0265159 A1 * 12/2004 Furusho ..... F04C 18/0215 418/55.6
2006/0216182 A1 * 9/2006 Kohsokabe ..... F04C 29/028 418/55.6
2010/0092321 A1 * 4/2010 Kim ..... F04C 29/028 418/55.6

(Continued)

FOREIGN PATENT DOCUMENTS

CN 105782030 A * 7/2016 ..... F04C 18/0215
JP 64-3285 A 1/1989

(Continued)

*Primary Examiner* — Mark A Laurenzi
*Assistant Examiner* — Xiaoting Hu
(74) *Attorney, Agent, or Firm* — Mattingly & Malur, PC

(57) ABSTRACT

A scroll compressor includes a hermetic container, a fixed scroll, a swing scroll, a frame, an electric motor, and a shaft. A first groove and a second groove are provided outside a fixed wrap in a radial direction at an end plate surface of the fixed scroll. An oil supply hole for guiding lubricant oil from a through-hole opens at an end plate surface of the swing scroll. A single opening of the oil supply hole alternately communicates with the first groove and the second groove along with swing of the swing scroll.

9 Claims, 11 Drawing Sheets

(56) References Cited

U.S. PATENT DOCUMENTS

| | | | | |
|---|---|---|---|---|
| 2013/0209303 | A1* | 8/2013 | Tsuka | F04C 18/0261 418/55.1 |
| 2013/0216416 | A1* | 8/2013 | Takeda | F04C 18/0253 418/55.1 |
| 2014/0010694 | A1* | 1/2014 | Tsuka | F04C 29/023 418/55.2 |
| 2014/0234148 | A1* | 8/2014 | Takeda | F04C 18/0269 418/55.2 |
| 2015/0147214 | A1* | 5/2015 | Nagahara | F04C 29/028 418/55.2 |
| 2016/0377081 | A1* | 12/2016 | Cho | F04C 18/0215 418/55.1 |
| 2018/0051697 | A1* | 2/2018 | Murakami | F04C 18/0253 |
| 2018/0340536 | A1* | 11/2018 | Berning | F04C 18/0215 |

FOREIGN PATENT DOCUMENTS

| | | | | | |
|---|---|---|---|---|---|
| JP | 2817511 | B2 | * | 10/1998 | |
| JP | 2011012621 | A | * | 1/2011 | |
| JP | 2012184709 | A | * | 9/2012 | |
| JP | 5459376 | B1 | * | 4/2014 | F04C 18/0215 |

* cited by examiner

SCROLL COMPRESSOR AND REFRIGERATION CYCLE DEVICE

CROSS-REFERENCE TO RELATED APPLICATION

This application claims priority from Japanese Patent Application No. 2020-099518 filed with the Japan Patent Office on Jun. 8, 2020, the entire content of which is hereby incorporated by reference.

BACKGROUND

1. Technical Field

One aspect of the present disclosure relates to a scroll compressor and the like.

2. Related Art

For example, the following technique has been known as the technique of suppressing excessive thrust loads (force in an axial direction) of a fixed scroll and a swing scroll of a scroll compressor. That is, in the scroll compressor relating to this technique, an oil groove is provided at an end plate surface of the fixed scroll, and high-pressure lubricant oil is introduced into the oil groove. In this manner, the force of separating an end plate surface of the swing scroll from the fixed scroll is generated. For example, there is a scroll compressor described in JP-A-64-3285 as the above-described technique. In this scroll compressor, four oil grooves are provided at an end plate surface of a fixed scroll. On the other hand, four oil supply holes are provided at a swing scroll.

SUMMARY

A scroll compressor includes: a hermetic container; a fixed scroll including a spiral fixed wrap and fixed to an inside of the hermetic container; a swing scroll including a spiral swing wrap forming, together with the fixed wrap, a compression chamber; a frame configured to support the swing scroll; an electric motor including a stator and a rotor; and a shaft including a through-hole for guiding lubricant oil and configured to rotate integrally with the rotor, in which a first groove and a second groove are provided outside the fixed wrap in a radial direction at an end plate surface of the fixed scroll, a position of the first groove is included in a first region in a fan shape about an axis of the shaft at the end plate surface of the fixed scroll, a position of the second groove is included in a second region in a fan shape about the axis of the shaft, the second region being shifted from the first region in a circumferential direction by a predetermined amount, an oil supply hole for guiding the lubricant oil from the through-hole opens at an end plate surface of the swing scroll, and a single opening of the oil supply hole alternately communicates with the first groove and the second groove along with swing of the swing scroll.

DETAILED DESCRIPTION

Figure 1:
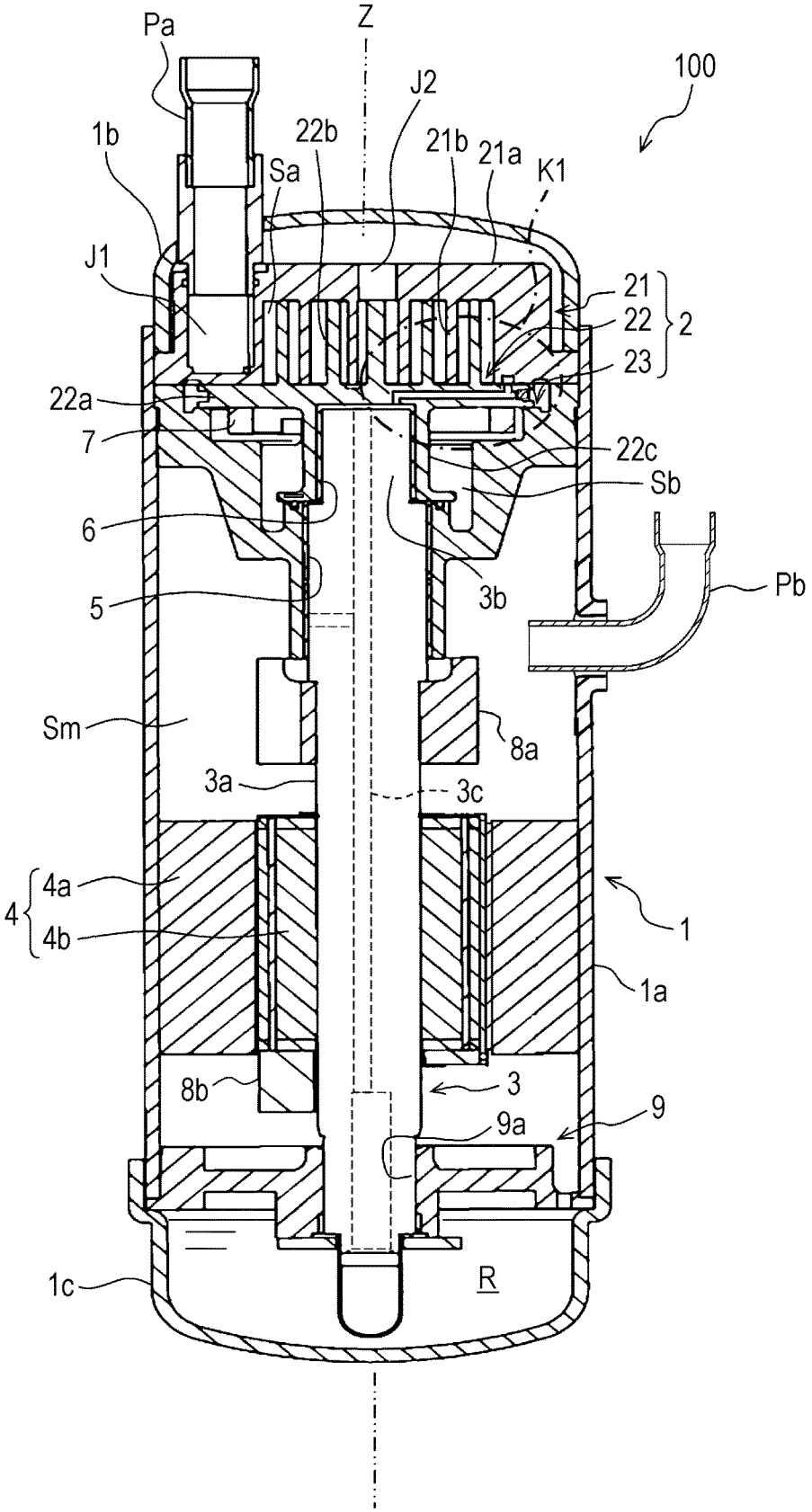
FIG. 1 is a longitudinal sectional view of a scroll compressor according to a first embodiment.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 3:
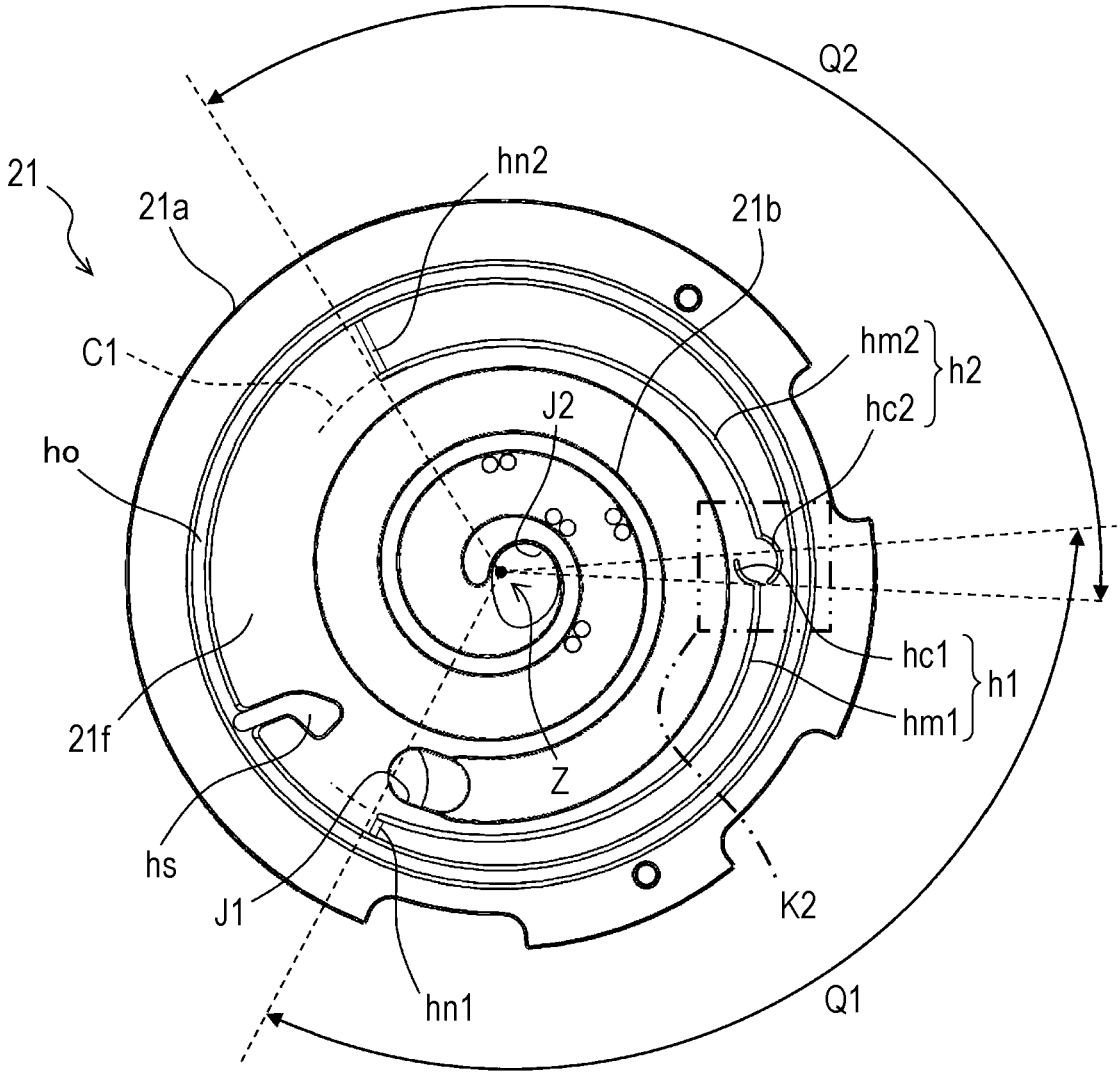
FIG. 3 is a bottom view of a fixed scroll of the scroll compressor according to the first embodiment.

In the technique described in JP-A-64-3285, the single oil supply hole is provided for the single oil groove in one-to-one correspondence. Thus, in a case where four oil grooves are provided at the fixed scroll, four oil supply holes are, at the swing scroll, provided corresponding to these oil grooves. As described above, in the case of providing four oil supply holes, two through-holes crossing in a cross shape in the swing scroll are provided (FIG. 3 of JP-A-64-3285). Thus, processing of the through-holes requires steps and time.

Further, in the technique described in JP-A-64-3285, openings at four locations need to be sealed with seals for preventing outflow of the lubricant oil through the openings of the above-described through-holes. This leads to an increase in the number of components and a manufacturing cost. Although both of cost reduction and reliability improvement are demanded, JP-A-64-3285 fails to describe the technique of meeting both of these demands.

For this reason, one object of the present disclosure is to provide, e.g., a low-cost highly-reliable scroll compressor.

A scroll compressor according to an aspect of the present disclosure includes: a hermetic container; a fixed scroll including a spiral fixed wrap and fixed to an inside of the hermetic container; a swing scroll including a spiral swing wrap forming, together with the fixed wrap, a compression chamber; a frame configured to support the swing scroll; an electric motor including a stator and a rotor; and a shaft including a through-hole for guiding lubricant oil and configured to rotate integrally with the rotor, in which a first groove and a second groove are provided outside the fixed wrap in a radial direction at an end plate surface of the fixed scroll, a position of the first groove is included in a first region in a fan shape about an axis of the shaft at the end plate surface of the fixed scroll, a position of the second groove is included in a second region in a fan shape about the axis of the shaft, the second region being shifted from the first region in a circumferential direction by a predetermined amount, an oil supply hole for guiding the lubricant oil from the through-hole opens at an end plate surface of the swing scroll, and a single opening of the oil supply hole alternately communicates with the first groove and the second groove along with swing of the swing scroll.

According to the above-described aspect of the present disclosure, e.g., the low-cost highly-reliable scroll compressor can be provided.

First Embodiment

<Configuration of Scroll Compressor>

FIG. 1 is a longitudinal sectional view of a scroll compressor 100 according to a first embodiment.

The scroll compressor 100 illustrated in FIG. 1 is equipment configured to compress refrigerant in a gas form. As illustrated in FIG. 1, the scroll compressor 100 includes a hermetic container 1, a compression mechanism 2, a crankshaft 3 (a shaft), an electric motor 4, a main bearing 5, and a swing bearing 6. In addition to the above-described configuration, the scroll compressor 100 further includes an Oldham's ring 7, balance weights 8*a*, 8*b*, and a subframe 9.

The hermetic container 1 is a shell-shaped container configured to house the compression mechanism 2, the crankshaft 3, the electric motor 4 and the like, and is substantially hermetically sealed. In the hermetic container 1, lubricant oil for enhancing the lubricity of the compression mechanism 2 and each bearing is sealed. The lubricant oil is stored at a bottom portion of the hermetic container 1 as an oil sump R. The hermetic container 1 includes a cylindrical tubular chamber 1*a*, a lid chamber 1*b* closing an upper side of the tubular chamber 1*a*, and a bottom chamber 1*c* closing a lower side of the tubular chamber 1*a*.

As illustrated in FIG. 1, a suction pipe Pa is inserted into and fixed to the lid chamber 1*b* of the hermetic container 1. The suction pipe Pa is a pipe configured to guide refrigerant to a suction port J1 of the compression mechanism 2. Moreover, a discharge pipe Pb is inserted into and fixed to the tubular chamber 1*a* of the hermetic container 1. The discharge pipe Pb is a pipe configured to guide refrigerant compressed in the compression mechanism 2 to the outside of the scroll compressor 100.

The compression mechanism 2 is a mechanism configured to compress refrigerant in a gas form along with rotation of the crankshaft 3. The compression mechanism 2 includes a fixed scroll 21, a swing scroll 22, and a frame 23. The compression mechanism 2 is arranged in an upper space in the hermetic container 1.

Figure 4:
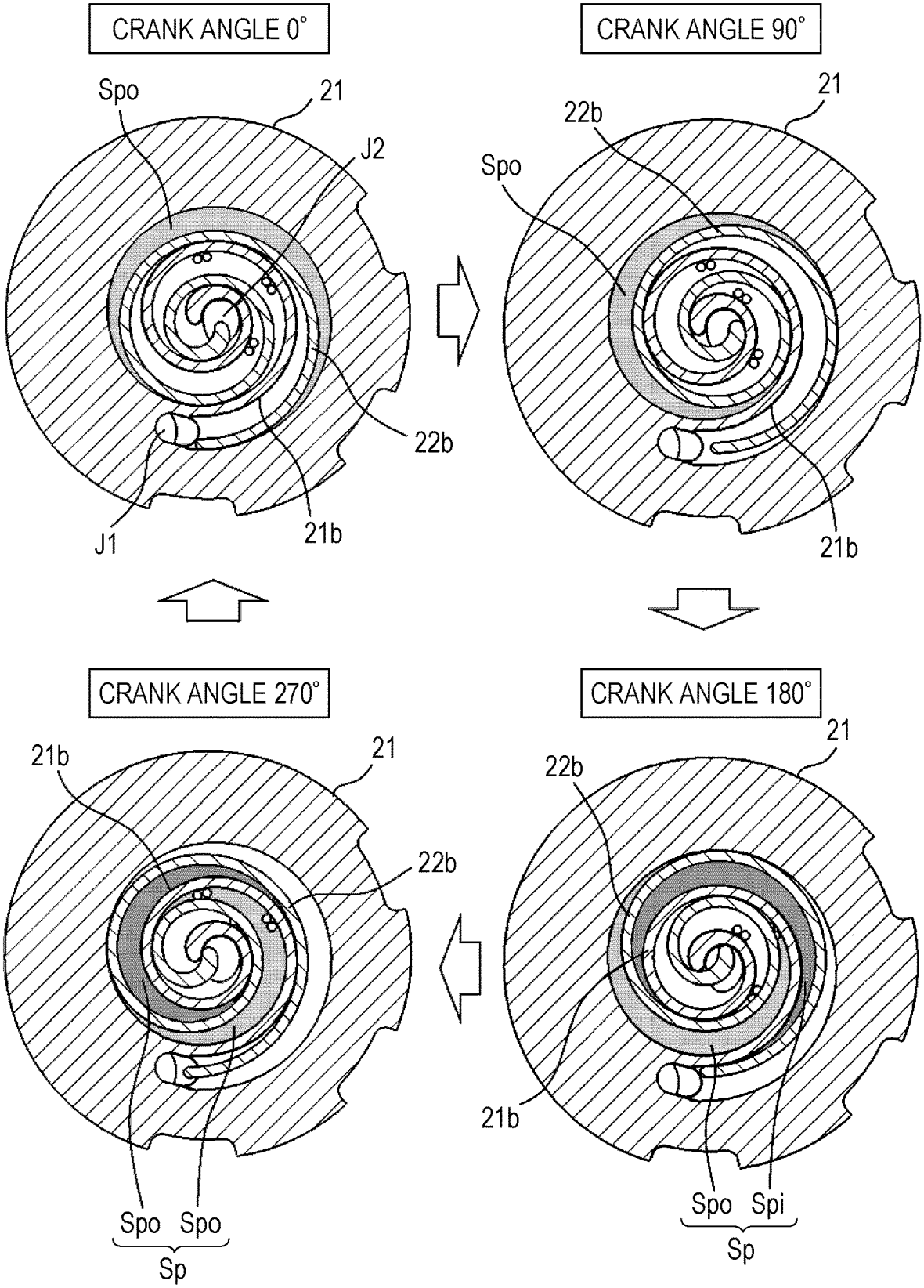
FIG. 4 is a view for describing the states of an external-line-side compression chamber and an internal-line-side compression chamber when a crank angle of a swing scroll of the scroll compressor according to the first embodiment is 0°, 90°, 180°, and 270°.

The fixed scroll 21 is a member forming, together with the swing scroll 22, compression chambers Sp (see FIG. 4). The fixed scroll 21 is fixed to the inside of the hermetic container 1. As illustrated in FIG. 1, the fixed scroll 21 includes a base plate 21*a* and a fixed wrap 21*b*.

The base plate 21*a* is a thick member in a circular shape as viewed in plane. Note that for ensuring a region Sa (a circular region as viewed from below) in which a swing wrap 22*b* swings relative to the fixed wrap 21*b*, the vicinity of the center of the base plate 21*a* is, as viewed from below, upwardly recessed by a predetermined amount. Moreover, the suction port J1 to which refrigerant is guided through the suction pipe Pa is provided at a predetermined location of the base plate 21*a*.

The fixed wrap 21*b* is in a spiral shape, and downwardly extends from the base plate 21*a* in the region Sa. Note that at a lower surface of the base plate 21*a*, an outer portion of the region Sa in a radial direction and a lower end of the fixed wrap 21*b* are substantially flush with each other. Moreover, the lower surface of the base plate 21*a* will be also referred to as an end plate surface 21*f* (see FIG. 3) of the fixed scroll 21. At the end plate surface 21*f* of the fixed scroll 21, a first groove h1 (see FIG. 3) and a second groove h2 (see FIG. 3) are provided. Details of these grooves will be described later.

The swing scroll 22 is a member configured to move (swing) to form the compression chambers Sp (see FIG. 4) between the swing scroll 22 and the fixed scroll 21. The swing scroll 22 is provided between the fixed scroll 21 and the frame 23. The swing scroll 22 includes a discoid end plate 22*a*, the spiral swing wrap 22*b* standing on the end plate 22*a*, and a tubular boss portion 22*c* fitted onto an eccentric portion 3*b* of the crankshaft 3. As illustrated in FIG. 1, the swing wrap 22*b* upwardly extends from the end plate 22*a*. On the other hand, the boss portion 22*c* downwardly extends from the end plate 22*a*.

The spiral fixed wrap 21*b* and the spiral swing wrap 22*b* engage with each other, thereby forming the multiple compression chambers Sp (see FIG. 4) between the fixed wrap 21*b* and the swing wrap 22*b*. That is, the swing wrap 22*b* and the fixed wrap 21*b* together form the compression chambers Sp. Note that the compression chamber Sp (see FIG. 4) is a space for compressing refrigerant in a gas form. The compression chambers Sp are each formed on an external line side and an internal line side of the swing wrap 22*b*. A discharge port J2 is provided in the vicinity of the center of the base plate 21*a* of the fixed scroll 21. The discharge port J2 guides refrigerant compressed in the compression chambers Sp to the upper space in the hermetic container 1.

The frame 23 is a member configured to support the swing scroll 22, and is fixed to the tubular chamber 1*a* of the hermetic container 1. A hole (a reference numeral thereof is not shown in the figure) into which an upper portion of a spindle 3*a* of the crankshaft 3 is inserted is provided at the frame 23.

Moreover, a back pressure chamber Sb is provided at the frame 23. The back pressure chamber Sb is a space having a predetermined intermediate pressure between a suction pressure and a discharge pressure. The back pressure chamber Sb is provided on a back side of the swing scroll 22. The upward force of pressing the swing scroll 22 against the fixed scroll 21 acts on the swing scroll 22 from the back pressure chamber Sb. Such upward force is force against the downward force of separating the swing scroll 22 from the fixed scroll 21, the downward force being generated by refrigerant compression.

The crankshaft 3 is a shaft configured to rotate integrally with a rotor 4*b* of the electric motor 4, and extends in an upper-lower direction. As illustrated in FIG. 1, the crankshaft 3 includes the spindle 3*a* and the eccentric portion 3*b* upwardly extending from the spindle 3*a*.

The spindle 3*a* is coaxially fixed to the rotor 4*b* of the electric motor 4. The spindle 3*a* rotates integrally with the rotor 4*b*. The eccentric portion 3*b* is a shaft configured to rotate eccentrically with respect to the spindle 3*a*. As described above, the eccentric portion 3*b* is fitted in the boss portion 22*c* of the swing scroll 22. The eccentric portion 3*b* eccentrically rotates, and the swing scroll 22 swings accordingly.

The crankshaft 3 has a through-hole 3*c* for guiding the lubricant oil. The lubricant oil stored as the oil sump R in the hermetic container 1 moves up through the through-hole 3*c* due to, e.g., a pressure difference between a motor chamber Sm and the back pressure chamber Sb. Note that the through-hole 3*c* is branched in a predetermined pattern such that the lubricant oil is also supplied to the main bearing 5, the swing bearing 6, a sub-bearing 9*a* and the like as described later.

The electric motor 4 is a drive source configured to rotate the crankshaft 3, and is placed between the frame 23 and the subframe 9 in the axial direction. As illustrated in FIG. 1, the electric motor 4 includes a stator 4*a* and the rotor 4*b*. The stator 4*a* is fixed to an inner peripheral wall of the tubular chamber 1*a*. The rotor 4*b* is rotatably arranged inside the stator 4*a* in the radial direction. The crankshaft 3 is, by, e.g., press-fitting, fixed to the rotor 4*b* such that the crankshaft 3 is coaxial with the center axis of the rotor 4*b*.

The main bearing 5 pivotably supports the upper portion of the spindle 3*a* such that such an upper portion is rotatable relative to the frame 23. The main bearing 5 is fixed to a peripheral wall surface of the hole (the reference numeral thereof is not shown in the figure) of the frame 23.

The swing bearing 6 pivotably supports the eccentric portion 3*b* such that the eccentric portion 3*b* is rotatable with respect to the boss portion 22*c* of the swing scroll 22. The swing bearing 6 is fixed to an inner peripheral wall of the boss portion 22*c*.

The Oldham's ring 7 is a ring-shaped member configured to swing, without rotation of the swing scroll 22 itself, the swing scroll 22 in response to eccentric rotation of the eccentric portion 3*b* of the crankshaft 3. The Oldham's ring 7 is attached to a groove (not shown) provided at a lower surface of the swing scroll 22 and a groove (not shown) provided at a predetermined location of the frame 23.

The balance weights 8*a*, 8*b* are members for reducing vibration of the scroll compressor 100. In an example of FIG. 1, the balance weight 8*a* is placed above the rotor 4*b* on the spindle 3*a*. Moreover, another balance weight 8*b* is placed on a lower surface of the rotor 4*b*.

The subframe 9 is a member configured to rotatably pivotably support a lower portion of the spindle 3*a*, and includes the sub-bearing 9*a*. As illustrated in FIG. 1, the subframe 9 is fixed to the hermetic container 1 in a state in which the subframe 9 is arranged on a lower side of the electric motor 4. A hole (a reference numeral thereof is not shown in the figure) into which the crankshaft 3 is inserted is provided at the subframe 9. The sub-bearing 9*a* is fixed to a peripheral wall surface of this hole.

When the crankshaft 3 rotates by drive of the electric motor 4, the swing scroll 22 swings accordingly. Then, the compression chambers Sp (see FIG. 4) formed one after another are narrowed to compress refrigerant in a gas form. The compressed refrigerant is discharged to the upper space in the hermetic container 1 through the discharge port J2 of the fixed scroll 21. The refrigerant discharged through the discharge port J2 is guided to the motor chamber Sm through a predetermined flow path (not shown) between the compression mechanism 2 and the hermetic container 1. The refrigerant is further discharged to the outside through the discharge pipe Pb.

The lubricant oil stored as the oil sump R on the bottom of the hermetic container 1 moves up through the through-hole 3*c* of the crankshaft 3, thereby lubricating the sub-bearing 9*a*, the main bearing 5, the swing bearing 6 and the like. Then, part of the lubricant oil is guided to the back pressure chamber Sb and the compression chambers Sp. This seals a portion between the fixed wrap 21*b* and the swing wrap 22*b*. Moreover, each sliding portion of the compression mechanism 2 is lubricated. Meanwhile, the remaining lubricant oil is guided to, e.g., an oil supply hole hg (see FIG. 2) of the swing scroll 22 as described later.

Next, detailed configurations of the fixed scroll 21 and the swing scroll 22 will be described while the flow of the lubricant oil is described.

Figure 2:
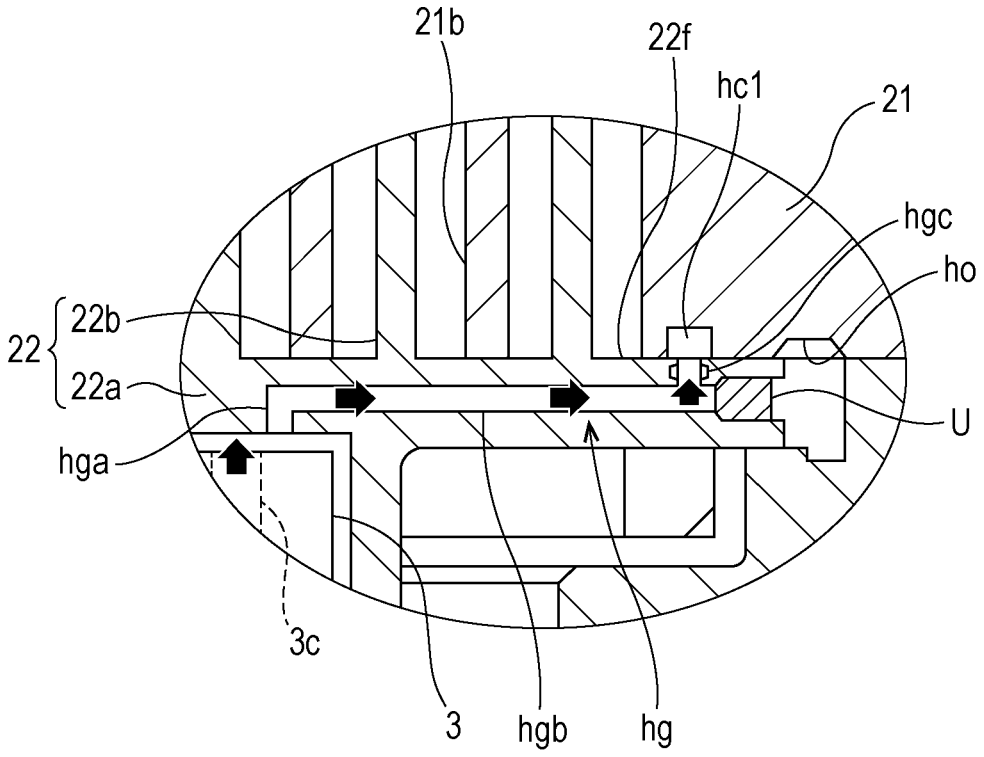
FIG. 2 is a partially-enlarged view of a region K1 of FIG. 1 in the scroll compressor according to the first embodiment.

FIG. 2 is a partially-enlarged view of a region K1 of FIG. 1.

Note that in FIG. 2, the flow of the lubricant oil is indicated by arrows. Moreover, FIG. 2 illustrates a state in which the oil supply hole hg of the swing scroll 22 communicates with a later-described first control groove hc1.

As illustrated in FIG. 2, the oil supply hole hg is provided at the end plate 22*a* of the swing scroll 22. The oil supply hole hg is a flow path configured to guide, to a fixed scroll 21 side, high-pressure lubricant oil flowing out through the through-hole 3*c* of the crankshaft 3. An upstream side of the oil supply hole hg opens in the vicinity of the center of a lower surface of the end plate 22*a*. A downstream side of the oil supply hole hg opens at a predetermined location of an upper surface (i.e., an end plate surface 22*f*) of the end plate 22*a*.

The oil supply hole hg includes flow paths hga, hgb, hgc in this order toward the downstream side. The flow path hga is provided in the upper-lower direction to guide, to another flow path hgb, the lubricant oil having flowed in through the opening of the lower surface of the end plate 22*a*. The flow path hgb is provided in parallel (the radial direction) with the plate surface of the end plate 22*a* of the swing scroll 22. For example, the flow path hgb is formed in such a manner that predetermined cutting processing is performed inwardly in the radial direction from a peripheral wall surface of the end plate 22*a*. The flow path hgc is provided in the upper-lower direction to guide the lubricant oil flowing in the flow path hgb to the opening of the upper surface of the end plate 22*a*. A seal U illustrated in FIG. 2 is a member configured to seal an outer-peripheral-side end portion of the flow path hgc. The high-pressure lubricant oil is guided to the fixed scroll 21 side sequentially through the flow paths hga, hgb, hgc.

FIG. 3 is a bottom view of the fixed scroll 21 provided in the scroll compressor.

As described above, the fixed scroll 21 is configured such that the spiral fixed wrap 21*b* is provided on the base plate 21*a*. As illustrated in FIG. 3, an annular outer peripheral groove ho is provided in the vicinity of a peripheral edge of the end plate surface 21*f* of the fixed scroll 21. The outer peripheral groove ho has the function of reducing extra compression power due to influence of the lubricant oil having entered between the end plate 22*a* of the swing scroll 22 and the frame 23. The outer peripheral groove ho faces a predetermined clearance (part of the back pressure chamber Sb) between the swing scroll 22 and the frame 23.

As illustrated in FIG. 3, an arc-shaped first oil groove hm1 and an arc-shaped second oil groove hm2 are provided at the end plate surface 21*f* on the outside of the fixed wrap 21*b* in the radial direction. The first oil groove hm1 and the second oil groove hm2 are grooves for supplying the high-pressure lubricant oil across an arc-shaped predetermined area. The first oil groove hm1 and the second oil groove hm2 are provided along the fixed wrap 21*b* on the outside of the fixed wrap 21*b* in the radial direction. The phrase "the first oil groove hm1 and the second oil groove hm2 are provided along the fixed wrap 21*b*" as described herein means that the first oil groove hm1 and the second oil groove hm2 are, at the end plate surface 21*f* of the fixed scroll 21, in predetermined arc shapes about the vicinity of the axis Z of the crankshaft 3 (see FIG. 1).

In an example of FIG. 3, the first oil groove hm1 and the second oil groove hm2 are provided such that a single arc-shaped curve Cl (a dashed line) about the axis Z of the crankshaft 3 (see FIG. 1) includes the first oil groove hm1 and the second oil groove hm2 Moreover, the first oil groove hm1 and the second oil groove hm2 are close to each other, but do not communicate with each other.

The first control groove hc1 intermittently communicates with the oil supply hole hg (see FIG. 2) of the swing scroll 22 in association with movement (swing) of the swing scroll 22. The first control groove hc1 is in an arc shape, and communicates with the first oil groove hm1. More specifically, one end of the first control groove hc1 is connected to an end portion (an end portion of the first oil groove hm1 on a side close to the second oil groove hm2) of the first oil groove hm1. Moreover, the other end of the first control groove hc1 is provided at a position which is close to the second oil groove hm2, but is slightly apart from the second oil groove hm2 Note that a groove including the first oil groove hm1 and the first control groove hc1 will be referred to as the "first groove h1."

A second control groove hc2 intermittently communicates with the oil supply hole hg (see FIG. 2) of the swing scroll 22 in association with movement (swing) of the swing scroll 22. The second control groove hc2 is in an arc shape, and communicates with the second oil groove hm2 More specifically, one end of the second control groove hc2 is connected to an end portion (an end portion of the second oil groove hm2 on a side close to the first oil groove hm1) of the second oil groove hm2 Moreover, the other end of the second control groove hc2 is provided at a position which is close to the first oil groove hm1, but is slightly apart from the first oil groove hm1. Note that a groove including the second oil groove hm2 and the second control groove hc2 will be referred to as the "second groove h2."

As illustrated in FIG. 3, the first groove h1 and the second groove h2 are provided outside the fixed wrap 21*b* in the radial direction at the end plate surface 21*f* of the fixed scroll 21. The position of the first groove h1 as described herein is within a fan-shaped first region Q1 of the end plate surface 21*f* of the fixed scroll 21 about the axis Z of the crankshaft 3 (see FIG. 3). Moreover, the position of the second groove h2 is within a fan-shaped second region Q2 about the axis Z of the crankshaft 3 (see FIG. 3), the second region Q2 being shifted from the first region Q1 in a circumferential direction by a predetermined amount. At an overlapping portion of the first region Q1 and the second region Q2, the first control groove hc1 and the second control groove hc2 (part thereof) are provided. The high-pressure lubricant oil is intermittently supplied to the first groove h1 and the second groove h2 through the oil supply hole hg (see FIG. 2).

A first oil discharge groove hn1 is a groove causing the first groove h1 and the outer peripheral groove ho to communicate with each other. The first oil discharge groove hn1 is provided at the end plate surface 21*f* of the fixed scroll 21. The first oil discharge groove hn1 has the function of releasing the high-pressure lubricant oil having flowed in the first oil groove hm1 to the outer peripheral groove ho. As illustrated in FIG. 3, the straight first oil discharge groove hn1 is provided to connect an end portion of the first oil groove hm1 on a side apart from the second oil groove hm2 and the outer peripheral groove ho.

A second oil discharge groove hn2 is a groove causing the second groove h2 and the outer peripheral groove ho to communicate with each other. The second oil discharge groove hn2 is provided at the end plate surface 21*f* of the fixed scroll 21. The second oil discharge groove hn2 has the function of releasing the high-pressure lubricant oil having flowed in the second oil groove hm2 to the outer peripheral groove ho. As illustrated in FIG. 3, the straight second oil discharge groove hn2 is provided to connect an end portion of the second oil groove hm2 on a side apart from the first oil groove hm1 and the outer peripheral groove ho.

FIG. 4 is a view for describing the states of an external-line-side compression chamber Spo and an internal-line-side compression chamber Spi when a crank angle of the swing scroll 22 is 0°, 90°, 180°, and 270°.

Note that in FIG. 4, the first groove h1 (see FIG. 3), the second groove h2 (see FIG. 3) and the like are not shown. Moreover, the crank angle when an end portion of the swing wrap 22*b* on a suction port J1 side contacts a wall surface of the fixed wrap 21*b* (the external-line-side compression chamber Spo is formed) is 0°.

As illustrated in FIG. 4, the external-line-side compression chamber (referred to as the external-line-side compression chamber Spo) and the internal-line-side compression chamber (referred to as the internal-line-side compression chamber Spi) of the swing wrap 22*b* are narrowed along with movement of the swing scroll 22 (see FIG. 1), and refrigerant is compressed. As a result, predetermined tangential gas load Fgt (see FIG. 5) and predetermined radial gas load Fgr (see FIG. 5) act on the swing scroll 22 (see FIG. 1) from the refrigerant in the middle of compression. Further, centrifugal force Fc also acts on the swing scroll 22.

Figure 5:
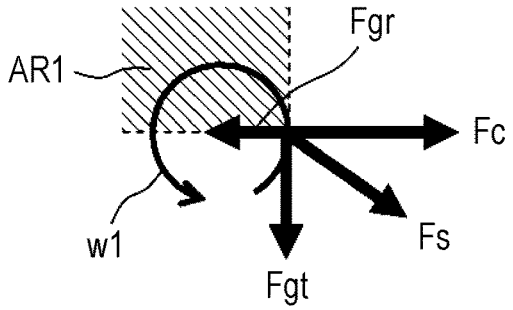
FIG. 5 is a view for describing a relationship among forces acting on the swing scroll of the scroll compressor according to the first embodiment.

FIG. 5 is a view for describing a relationship among the forces acting on the swing scroll 22 (see FIG. 1, as necessary).

Note that in FIG. 5, the swing wrap 22*b* is illustrated from above (i.e., in a direction from a tip end to a base end of the swing wrap 22*b*). FIG. 5 illustrates the relationship among the forces at a moment that the swing scroll 22 is eccentric to the right side in the plane of paper. Moreover, a reference numeral w1 in FIG. 5 indicates swing motion of the swing scroll 22.

The predetermined centrifugal force Fc acts on the swing scroll 22 in an eccentric direction thereof. Meanwhile, due to counteraction accompanied by refrigerant compression, the radial gas load Fgr acts on the swing scroll 22 in a direction opposite to the eccentric direction of the swing scroll 22. The tangential gas load Fgt also acts on the swing scroll 22 in a direction perpendicular to that of the radial gas load Fgr. Note that a gas load in the compression chamber Sp (see FIG. 4) is influenced by a change in the volume and pressure of the compression chamber Sp. Thus, the gas load in the compression chamber Sp does not always correspond to the crank angle.

For example, in a case where relatively-high-speed operation in which friction and abrasion are particularly likely to occur at the compression mechanism 2 is performed, the centrifugal force Fc is greater than the radial gas load Fgr. In this case, the resultant force Fs of the centrifugal force Fc, the radial gas load Fgr, and the tangential gas load Fgt is diagonally in a lower right direction in the plane of paper of FIG. 5. Further, although not shown in FIG. 5, an axial gas load for downwardly pressing the swing scroll 22 from refrigerant also acts on the swing scroll 22.

As a result, the moment of force tilting the swing scroll 22 in the direction of the resultant force Fs is generated. Thus, in a region (referred to as an offset load region AR1) on a side opposite to the resultant force Fs, the end plate surface 21*f* of the fixed scroll 21 and the end plate surface 22*f* of the swing scroll 22 tend to strongly contact each other. For this reason, in the first embodiment, the high-pressure lubricant oil is alternately supplied to the first groove h1 (see FIG. 3) and the second groove h2 (see FIG. 3). Thus, when the crank angle is a predetermined crank angle that a thrust load on the swing scroll 22 tends to be great, the force of separating the swing scroll 22 from the fixed scroll 21 is generated in the offset load region AR1.

Note that the eccentric direction of the swing scroll 22 changes (rotates) in association with a change in the crank angle. Thus, in the present embodiment, the force in the direction of separating the swing scroll 22 from the fixed scroll 21 is generated in the offset load region AR1 illustrated in FIG. 5 with reference to the eccentric direction of the swing scroll 22 with the predetermined crank angle (the predetermined crank angle that the thrust load tends to be great).

Figure 6:
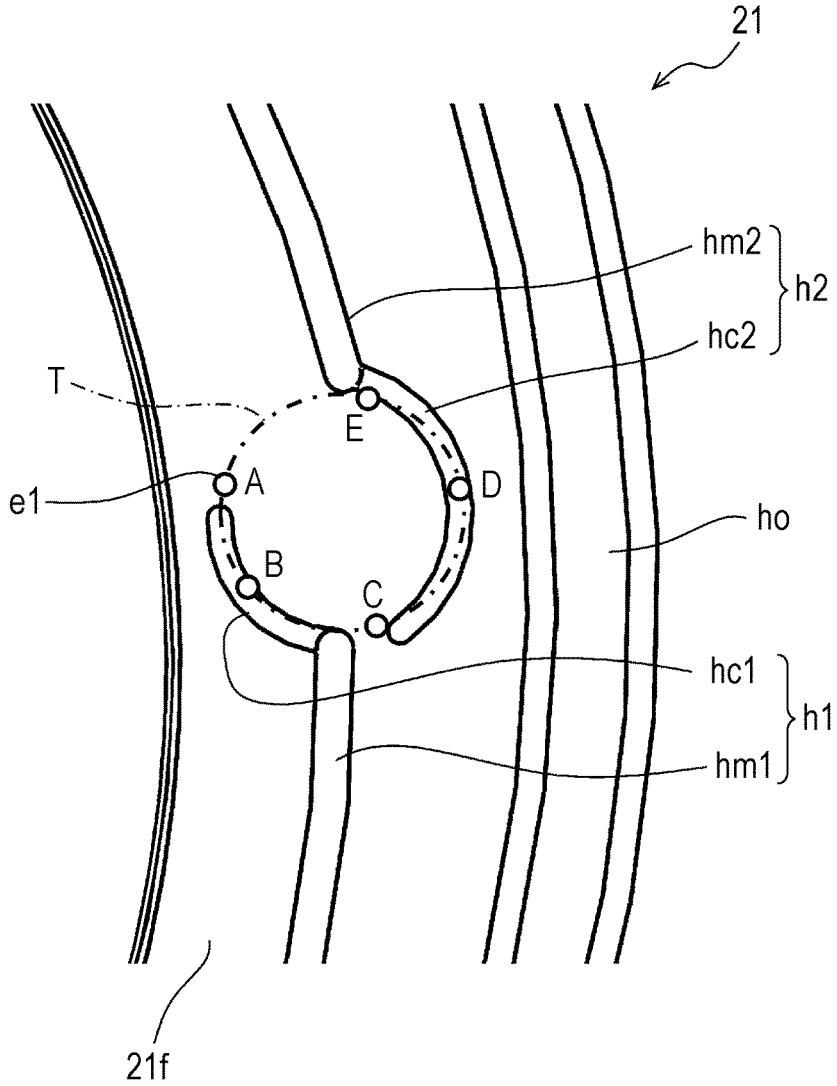
FIG. 6 is a partially-enlarged view of a movement trajectory of an opening of an oil supply hole in a region K2 of FIG. 3 in the scroll compressor according to the first embodiment.

FIG. 6 is a partially-enlarged view of a movement trajectory T of an opening e1 of the oil supply hole in a region K2 of FIG. 3 (also see FIGS. 1 and 2, as necessary).

As a crank angle of the scroll compressor 100 increases, the opening e1 of the oil supply hole hg moves counterclockwise in the plane of paper of FIG. 6. Moreover, the first control groove hc1 and the second control groove hc2 are provided in an arc shape to partially overlap with the movement trajectory T of the opening e1 of the oil supply hole hg (a circle indicated by a chain line of FIG. 6). Note that on the movement trajectory T of the opening e1 of the oil supply hole hg at the end plate surface 21*f* of the fixed scroll 21, an area (a predetermined area including a position B) where the first control groove hc1 communicates with the opening e1 and an area (a predetermined area including a position D) where the second control groove hc2 communicates with the opening e1 are different from each other.

For example, when the crank angle slightly advances from that at a position A indicating the opening e1 of the oil supply hole hg, the opening e1 and the first control groove hc1 start communicating with each other. Then, the high-pressure lubricant oil is supplied to the first control groove hc1 and the first oil groove hm1 through the opening e1 of the oil supply hole hg (e.g., the position B). As a result, in the first groove h1, the force in the direction of separating the swing scroll 22 from the fixed scroll 21 is generated. Thus, abrasion of the fixed scroll 21 and the swing scroll 22 in the offset load region AR1 (see FIG. 5) can be reduced. Moreover, tilting of the swing scroll 22 is reduced so that refrigerant leakage from the compression chambers Sp (see FIG. 4) can be reduced on a side opposite to the offset load region AR1.

Note that the lubricant oil supplied to the first control groove hc1 and the first oil groove hm1 flows out sequentially through the first oil discharge groove hn1 and the outer peripheral groove ho illustrated in FIG. 3. Alternatively, such lubricant oil flows out through a minute clearance between the end plate surface 21*f* of the fixed scroll 21 and the end plate surface 22*f* of the swing scroll 22. As a result, the pressures of the first control groove hc1 and the first oil groove hm1 decrease, returning to an original state.

When the crank angle further advances and the opening e1 of the oil supply hole hg reaches a position C, the opening e1 and the first control groove hc1 no longer communicate with each other. When the crank angle further slightly advances such that the opening e1 of the oil supply hole hg passes by the position C, the opening e1 and the second control groove hc2 communicate with each other. Then, the high-pressure lubricant oil is supplied to the second control groove hc2 and the second oil groove hm2 through the opening e1 of the oil supply hole hg (e.g., a position D). As a result, in the second groove h2, the force in the direction of separating the swing scroll 22 from the fixed scroll 21 is generated.

Note that the lubricant oil supplied to the second control groove hc2 and the second oil groove hm2 flows out sequentially through the second oil discharge groove hn2 and the outer peripheral groove ho illustrated in FIG. 3. Alternatively, such lubricant oil flows out through the minute clearance between the end plate surface 21*f* of the fixed scroll 21 and the end plate surface 22*f* of the swing scroll 22. As a result, the pressures of the second control groove hc2 and the second oil groove hm2 decrease, returning to an original state.

When the crank angle further advances and the opening e1 of the oil supply hole hg reaches a position E, the opening e1 and the second control groove hc2 no longer communicate with each other. Note that in a section from the position E to the position A in FIG. 6, the opening e1 does not communicate with either of the first control groove hc1 or the second control groove hc2. A reason is that in this section, the thrust load on the swing scroll 22 tends to be small (details will be described later), and therefore, it is not necessary to supply the high-pressure lubricant oil to the first control groove hc1 and the second control groove hc2 through the opening e1. As described above, as the swing scroll 22 swings, the single (i.e., the same) opening e1 of the oil supply hole hg alternately communicates with the first groove h1 and the second groove h2.

Note that the axis Z (see FIG. 3) of the crankshaft 3, the first control groove hc1, and the second control groove hc2 preferably partially overlap with each other in the radial direction. According to such a configuration, the areas of the first control groove hc1 and the second control groove hc2 are set as necessary in a design phase of the scroll compressor 100 so that the first control groove hc1 and the second control groove hc2 can alternately communicate with the opening e1 of the oil supply hole hg.

The scroll compressor 100 is preferably configured such that when the crank angle of the swing scroll 22 is a high thrust load angle upon swing of the swing scroll 22, the opening e1 of the oil supply hole hg passes at least part of the predetermined offset load region AR1 (see FIG. 5). The high thrust load angle described herein is a predetermined crank angle advanced from the crank angle at the start of discharging of refrigerant (gas) from the compression chamber Sp by 180°. Moreover, the predetermined offset load region AR1 is a region forming, as viewed in plane, an angle of equal to or greater than 90° and equal to or less than 180° with respect to the direction of rotation of the crankshaft 3 with reference to the eccentric direction of the swing scroll 22. According to such a configuration, in the offset load region AR1 (see FIG. 5), the force of separating the swing scroll 22 from the fixed scroll 21 is generated. Thus, abrasion of each end plate surface 21*f*, 22*f* can be reduced. Moreover, tilting of the swing scroll 22 is reduced, and therefore, refrigerant leakage from the compression chambers Sp (see FIG. 4) can be reduced.

Note that in some cases, the pressure of the compression chamber Sp (see FIG. 4) does not reach a predetermined discharge pressure right before the start of discharging, and for this reason, refrigerant flows back to the compression chamber Sp through the discharge port J2 (a high pressure side) at a moment that the compression chamber Sp communicates with the discharge port J2. In the case of such a so-called insufficient compression condition, the pressure of the compression chamber Sp rapidly increases, and the thrust load on the swing scroll 22 from the fixed scroll 21 rapidly decreases. For this reason, the sealability of the compression chamber Sp (see FIG. 4) is degraded, and refrigerant leakage from the compression chambers Sp is easily caused.

Thus, in a case where the crank angle is the predetermined high thrust load angle as the crank angle opposite to that at the start of discharging of refrigerant from the compression chamber Sp by 180°, the opening e1 of the oil supply hole hg preferably communicates with the first control groove hc1 or the second control groove hc2. According to such a configuration, at the timing of starting discharging of refrigerant from the compression chamber Sp, no high-pressure lubricant oil is supplied to the first groove h1 and the second groove h2. Thus, even in the case of the above-described insufficient compression condition, degradation of the sealability of the compression chamber Sp can be reduced.

The center angle of the fan-shaped first region Q1 and the center angle of the fan-shaped second region Q2 about the axis Z (see FIG. 3) of the crankshaft 3 are preferably equal to or less than 180°. According to such a configuration, the positions of the first groove h1 provided in the first region Q1 and the second groove h2 provided in the second region Q2 in the circumferential direction are set as necessary so that tilting of the swing scroll 22 can be reduced.

The depth (the depth of the portion upwardly recessed in the axial direction) of the first oil discharge groove hn1 illustrated in FIG. 3 is preferably smaller than the depth of the first oil groove hm1. According to such a configuration, outflow of the high-pressure lubricant oil supplied to the first oil groove hm1 through the first oil discharge groove hn1 at once is reduced. As a result, a rapid decrease in the pressure of the first oil groove hm1 can be suppressed. Similarly, the depth of the second oil discharge groove hn2 is preferably smaller than the depth of the second oil groove hm2 With this configuration, a rapid decrease in the pressure of the second oil groove hm2 can be suppressed.

Features and Advantageous Effects

Figure 7A:
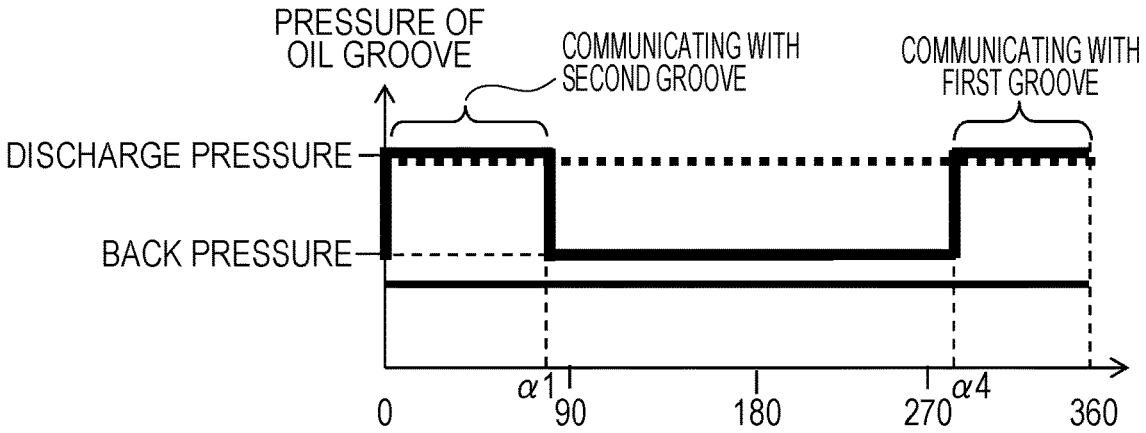
FIG. 7A is a graph for describing a change in the pressure of each oil groove in association with the crank angle in the scroll compressor according to the first embodiment and comparative examples.

FIG. 7A is a graph for describing a change in the pressure of each oil groove in association with the crank angle.

Figure 7B:
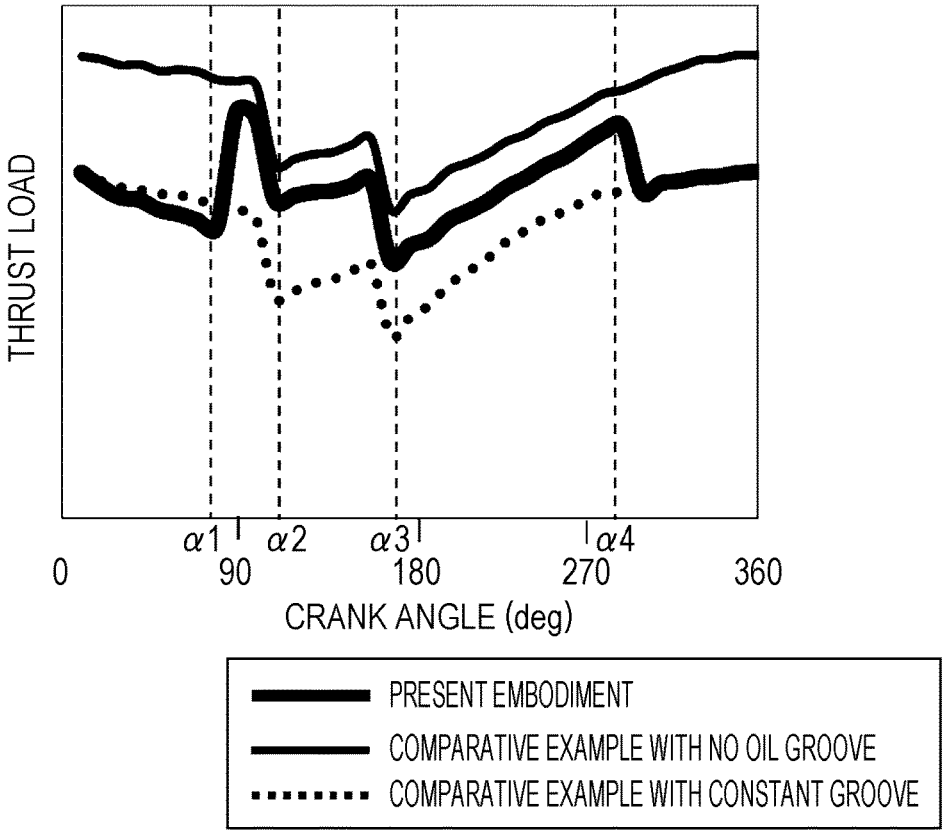
FIG. 7B is a graph for describing a change in a thrust load in association with the crank angle in the scroll compressor according to the first embodiment and the comparative examples.

FIG. 7B is a graph for describing a change in the thrust load in association with the crank angle (see FIGS. 3 and 6, as necessary).

Note that the horizontal axes of FIGS. 7A and 7B are the crank angle of the scroll compressor 100. The vertical axis of FIG. 7A is the pressure of each oil groove. The vertical axis of FIG. 7B is the thrust load (the force in the axial direction) acting on the swing scroll 22. Note that FIG. 7B illustrates the thrust load under the above-described insufficient compression condition.

In FIGS. 7A and 7B, the case of using the scroll compressor 100 according to the present embodiment (the first embodiment) is indicated by a thick solid line. Moreover, as "COMPARATIVE EXAMPLE WITH NO OIL GROOVE," a case where no predetermined oil groove to which the high-pressure lubricant oil is supplied is provided at the fixed scroll 21 is indicated by a thin solid line. Regarding the comparative example, the pressure (the static pressure) of the clearance between the end plate surfaces 21*f*, 22*f* is indicated by a thin solid line in FIG. 7B (the vertical axis thereof is the pressure of the oil groove). Further, as "COMPARATIVE EXAMPLE WITH CONSTANT PRESSURE GROOVE," a case where an annular oil groove (a constant pressure groove: not shown) to which the high-pressure lubricant oil is constantly supplied is provided at the end plate surface 21*f* of the fixed scroll 21 is indicated by a dashed line.

In "COMPARATIVE EXAMPLE WITH NO OIL GROOVE" indicated by the thin solid line, no high-pressure lubricant oil is supplied to the clearance between the end plate surface 21*f* of the fixed scroll 21 and the end plate surface 22*f* of the swing scroll 22. Thus, the pressure of such a clearance is lower than a predetermined back pressure (see FIG. 7A), and the thrust load is a relatively-great value (see FIG. 7B). Note that with reference to "COMPARATIVE EXAMPLE WITH NO OIL GROOVE" (the thin solid line) in FIG. 7B, a moment (crank angles $\alpha$2, $\alpha$3) that the thrust load rapidly decreases is caused twice in a crank angle range of 0° to 360°. This is because the external-line-side compression chamber Spo (see FIG. 4) and the internal-line-side compression chamber Spi (see FIG. 4) of the scroll compressor communicate with the discharge port J2 at different points of time.

Specifically, under the insufficient compression condition, high-pressure (discharge-pressure) refrigerant flows back to the compression chamber Sp at a moment that the compression chamber Sp communicates with the discharge port J2. Thus, the pressure of the compression chamber Sp rapidly increases. As a result, the repulsion of separating the swing scroll 22 from the fixed scroll 21 increases, and the thrust load decreases (the crank angles $\alpha$2, $\alpha$3).

In "COMPARATIVE EXAMPLE WITH CONSTANT PRESSURE GROOVE" indicated by the dashed line, the high-pressure lubricant oil is continuously supplied to the annular oil groove (the constant pressure groove: not shown). Thus, the pressure of the oil groove is held in a state substantially equal to the discharge pressure (see FIG. 7A). Moreover, in "COMPARATIVE EXAMPLE WITH CONSTANT PRESSURE GROOVE," the thrust load is reduced only by a substantially constant amount at all crank angles as compared to "COMPARATIVE EXAMPLE WITH NO OIL GROOVE" (see FIG. 7B).

Note that in "COMPARATIVE EXAMPLE WITH CONSTANT PRESSURE GROOVE," a phenomenon that the thrust load rapidly decreases under the insufficient compression condition also occurs (the crank angles $\alpha$2, $\alpha$3 of FIG. 7B). As a result, there is a probability that the thrust load extremely decreases right after the start of discharging through the discharge port J2 and it is difficult to reduce tilting of the swing scroll 22. Accordingly, one-side contact of the compression mechanism 2 might be caused, and/or the clearance between the end plate surface 21*f* and the end plate surface 22*f* might be expanded. This leads to degradation of a volumetric efficiency.

On the other hand, in the present embodiment, the first control groove hc1 communicates with the opening e1 of the oil supply hole hg in a crank angle range of $\alpha$4 to 360° as indicated by the thick solid line of FIG. 7A (e.g., the position B of FIG. 6). Thus, the high-pressure lubricant oil is supplied to the first groove h1. Accordingly, the pressure of the first groove h1 becomes substantially equal to the discharge pressure. As a result, as indicated by the thick solid line of FIG. 7B, the thrust load decreases in a crank angle range of α4 to 360°.

Moreover, in the present embodiment, in a case where the crank angle is within a range of a predetermined value slightly greater than 0° (corresponding to the vicinity of the position C of FIG. 6) to a crank angle α1, the second control groove hc2 communicates with the opening e1 of the oil supply hole hg (e.g., the position D of FIG. 6). Thus, the high-pressure lubricant oil is supplied to the second groove h2. Accordingly, the pressure of the second groove h2 becomes substantially equal to the discharge pressure. As a result, as indicated by the thick solid line of FIG. 7B, the thrust load decreases even in a case where the crank angle is within a range of the predetermined value slightly greater than 0° (corresponding to the vicinity of the position C of FIG. 6) to the crank angle α1.

As described above, in the present embodiment, the high-pressure lubricant oil is alternately supplied to the first groove h1 and the second groove h2 at different points of time (i.e., in different crank angle ranges). As a result, in the offset load region AR1 (see FIG. 5) of the swing scroll 22, the downward force of separating the swing scroll 22 from the fixed scroll 21 is generated. Thus, strong contact of the swing scroll 22 with the fixed scroll 21 is reduced. As a result, abrasion of the compression mechanism 2 can be reduced.

In a crank angle range of α1 to α4, the supply of the high-pressure lubricant oil through the oil supply hole hg (see FIG. 2) is not performed. As illustrated in FIG. 7B, the crank angle range of α1 to α4 includes the crank angle α2 at which refrigerant discharging from the external-line-side compression chamber Spo (see FIG. 4) is started and the crank angle α3 at which refrigerant discharging from the internal-line-side compression chamber Spi (see FIG. 4) is started. At such start timing of discharging from each compression chamber, the oil supply through the oil supply hole hg is not performed. Thus, even under the insufficient compression condition, an extremely-small thrust load can be reduced. As a result, detachment of the swing scroll 22 can be reduced.

As described above, according to the present embodiment, tilting of the swing scroll 22 is reduced so that a friction loss between the end plate surfaces 21*f*, 22*f* in a section with a high thrust load can be reduced. As a result, occurrence of abrasion and seizure of the compression mechanism 2 can be reduced. Moreover, detachment of the swing scroll 22 from the fixed scroll 21 can be reduced. Thus, the sealability of the compression chamber Sp can be ensured. It may only be required that the single oil supply hole hg (see FIG. 2) is provided at the swing scroll 22. Thus, the number of steps of the cutting processing for providing the oil supply hole hg and the time of the cutting processing can be reduced. Further, the number of components of the seal U (see FIG. 2) can be reduced. Thus, a cost for manufacturing the scroll compressor 100 can be reduced. As described above, according to the present embodiment, the scroll compressor 100 with high reliability and performance can be provided at a low cost.

Second Embodiment

In a second embodiment (see FIG. 8), a first oil discharge groove hA1 of a fixed scroll 21A communicates with a suction port J1, and a second oil discharge groove hA2 communicates with a wrap groove hr. On this point, the second embodiment is different from the first embodiment (see FIG. 3). Note that the second embodiment is similar to the first embodiment on other points (e.g., an entire configuration of a scroll compressor: see FIG. 1). Thus, differences of the second embodiment from the first embodiment will be described below, and description of overlapping contents will be omitted.

Figure 8:
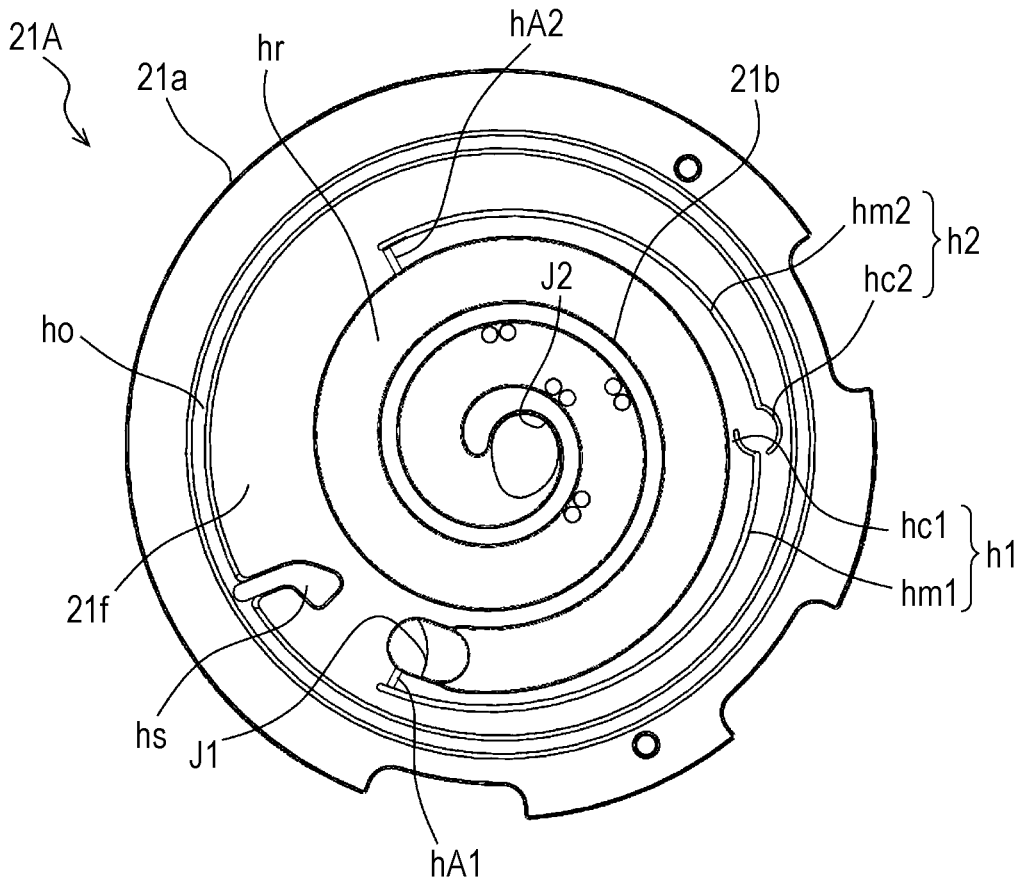
FIG. 8 is a bottom view of a fixed scroll provided in a scroll compressor according to a second embodiment.

FIG. 8 is a bottom view of the fixed scroll 21A provided in the scroll compressor according to the second embodiment.

The first oil discharge groove hA1 illustrated in FIG. 8 guides high-pressure lubricant oil having flowed in a first oil groove hm1 to the suction port J1 of the fixed scroll 21A. The first oil discharge groove hA1 is provided at a predetermined location of an end plate surface 21*f*. In an example of FIG. 8, the straight first oil discharge groove hA1 is provided to connect an end portion of the first oil groove hm1 on a side apart from a second oil groove hm2 and the suction port J1.

The second oil discharge groove hA2 guides high-pressure lubricant oil having flowed in the second oil groove hm2 to the wrap groove hr of the fixed scroll 21A. The second oil discharge groove hA2 is provided at a predetermined location of the end plate surface 21*f*. In the example of FIG. 8, the straight second oil discharge groove hA2 is provided to connect an end portion of the second oil groove hm2 on a side apart from the first oil groove hm1 and the wrap groove hr. Note that the wrap groove hr of the fixed scroll 21A is formed by an inner wall surface of a base plate 21*a* and a wall surface of a fixed wrap 21*b*.

Advantageous Effects

According to the second embodiment, the first oil discharge groove hA1 communicates with the suction port J1, and the second oil discharge groove hA2 communicates with the wrap groove hr. With this configuration, the lubricant oil flowing through the first oil discharge groove hA1 is, for example, supplied to compression chambers Sp (see FIG. 4), and therefore, refrigerant leakage from the compression chambers Sp can be reduced. Thus, according to the second embodiment, a leakage loss of the scroll compressor can be reduced, and the efficiency of the scroll compressor can be enhanced.

Third Embodiment

In a third embodiment (see FIG. 9), a first oil discharge groove hB1 of a fixed scroll 21B communicates with a suction port J1, and a second oil discharge groove hB2 communicates with an outer peripheral groove ho through a back pressure groove hk. On this point, the third embodiment is different from the first embodiment (see FIG. 3). Note that the third embodiment is similar to the first embodiment on other points (e.g., an entire configuration of a scroll compressor: see FIG. 1). Thus, differences of the third embodiment from the first embodiment will be described below, and description of overlapping contents will be omitted.

Figure 9:
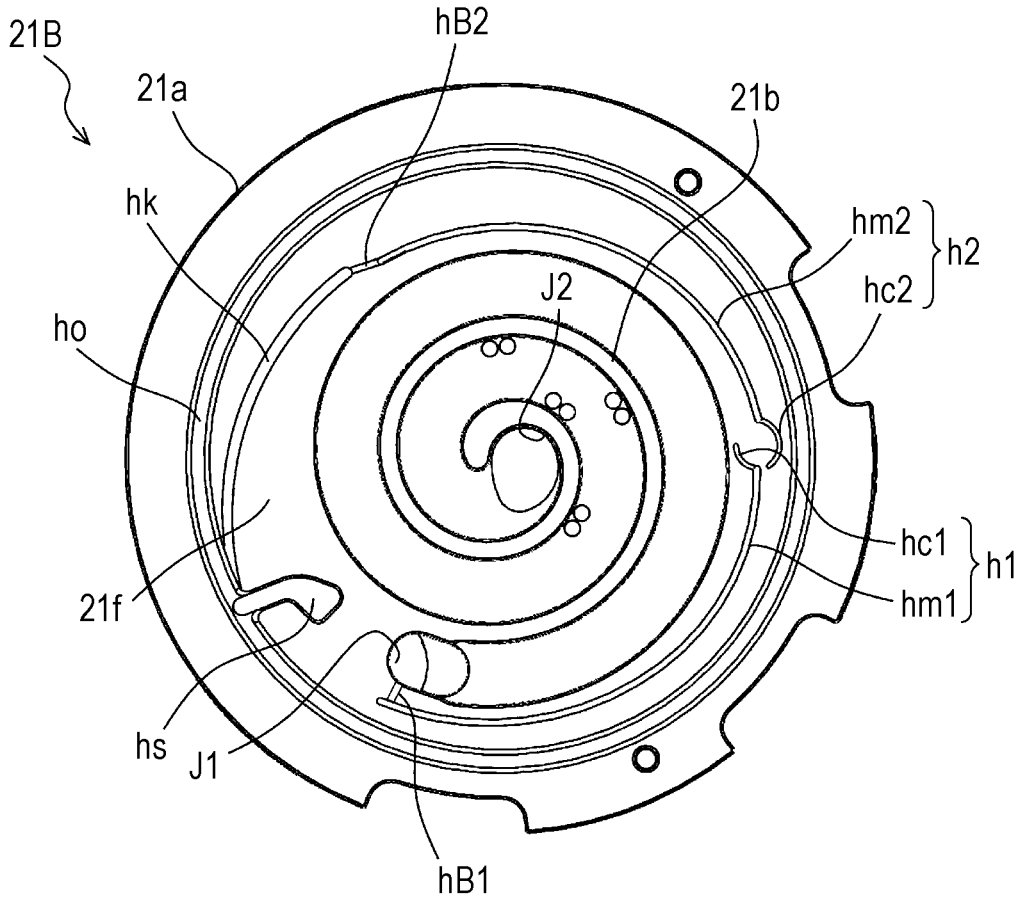
FIG. 9 is a bottom view of a fixed scroll provided in a scroll compressor according to a third embodiment.

FIG. 9 is a bottom view of the fixed scroll 21B provided in the scroll compressor according to the third embodiment.

The back pressure groove hk illustrated in FIG. 9 guides lubricant oil flowing through the second oil discharge groove hB2 to the outer peripheral groove ho (in an example of FIG. 9, the vicinity of a predetermined hole hs). The back pressure groove hk is in an arc shape. The second oil discharge groove hB2 is provided to connect an end portion of the second oil groove hm2 on a side apart from a first oil groove hm1 and an upstream-side end portion of the back pressure groove hk. Moreover, the first oil discharge groove hB1 is provided to connect an end portion of the first oil groove hm1 on a side apart from a second oil groove hm2 and the suction port J1.

Advantageous Effects

According to the third embodiment, high-pressure lubricant oil flowing in the second oil groove hm2 is supplied to the outer peripheral groove ho sequentially through the second oil discharge groove hB2 and the back pressure groove hk. With this configuration, the lubricant oil is supplied to an end plate surface 21*f* of the fixed scroll 21B. Thus, sealability and lubricity between end plate surfaces can be enhanced. Thus, the performance and reliability of the scroll compressor can be further enhanced as compared to the first embodiment.

Fourth Embodiment

In a fourth embodiment (see FIG. 10), the depth of a first oil groove hm1 is smaller than the depth of a first control groove hc1. On this point, the fourth embodiment is different from the first embodiment. Note that the fourth embodiment is similar to the first embodiment on other points (an entire configuration of a scroll compressor and arrangement of each groove as viewed from below: see FIGS. 1 and 3). Thus, differences of the fourth embodiment from the first embodiment will be described below, and description of overlapping contents will be omitted.

Figure 10:
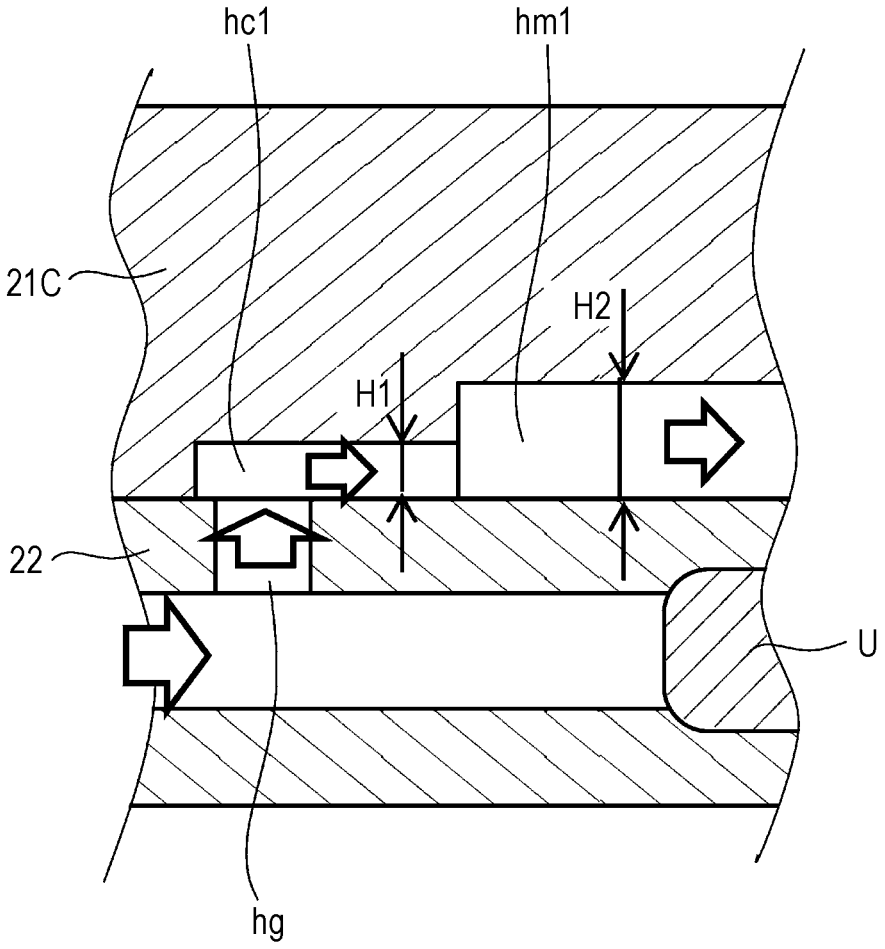
FIG. 10 is a longitudinal sectional view of a fixed scroll and a swing scroll provided in a scroll compressor according to a fourth embodiment.

FIG. 10 is a longitudinal sectional view of a fixed scroll 21C and a swing scroll 22 provided in the scroll compressor according to the fourth embodiment.

Note that in FIG. 10, the configuration of the vicinity of an oil supply hole hg is illustrated using a section along a predetermined curved surface (not shown) which is perpendicular to an end plate surface of the swing scroll 22 and passes the first control groove hc1 and the first oil groove hm1. Moreover, FIG. 10 illustrates a state when the oil supply hole hg communicates with the first control groove hc1.

As illustrated in FIG. 10, the depth H1 (the depth of a portion upwardly recessed from an end plate surface of the fixed scroll 21C) of the first control groove hc1 is preferably smaller than the depth H2 of the first oil groove hm1. According to such a configuration, in the first control groove hc1 having the relatively-smaller depth, a high-pressure lubricant oil flow path is narrowed. With this configuration, a rapid increase in the pressure of the first oil groove hm1 at a moment that the oil supply hole hg communicates with the first control groove hc1 can be reduced.

Note that the same also applies to a second control groove hc2 (see FIG. 3) and a second oil groove hm2 (see FIG. 3). That is, the depth of the second control groove hc2 is preferably smaller than the depth of the second oil groove hm2 With this configuration, a rapid increase in the pressure of the second oil groove hm2 at a moment that the oil supply hole hg communicates with the second control groove hc2 can be reduced.

Advantageous Effects

According to the fourth embodiment, rapid thrust load fluctuation accompanied by a supply of high-pressure lubricant oil can be reduced. As a result, abrasion and sealability degradation due to an uneven end plate surface pressure of the swing scroll 22 can be reduced. Thus, the performance and reliability of the scroll compressor can be further enhanced as compared to the first embodiment.

Fifth Embodiment

In a fifth embodiment (see FIG. 11), an overlapping area between an opening e1 of an oil supply hole hg (not shown in FIG. 11, see FIG. 2) and a first control groove hc1 gradually increases in the course of starting communication of the opening e1 with the first control groove hc1. On this point, the fifth embodiment is different from the first embodiment (see FIG. 3). Note that the fifth embodiment is similar to the first embodiment on other points (e.g., an entire configuration of a scroll compressor: see FIG. 1). Thus, differences of the fifth embodiment from the first embodiment will be described below, and description of overlapping contents will be omitted.

Figure 11:
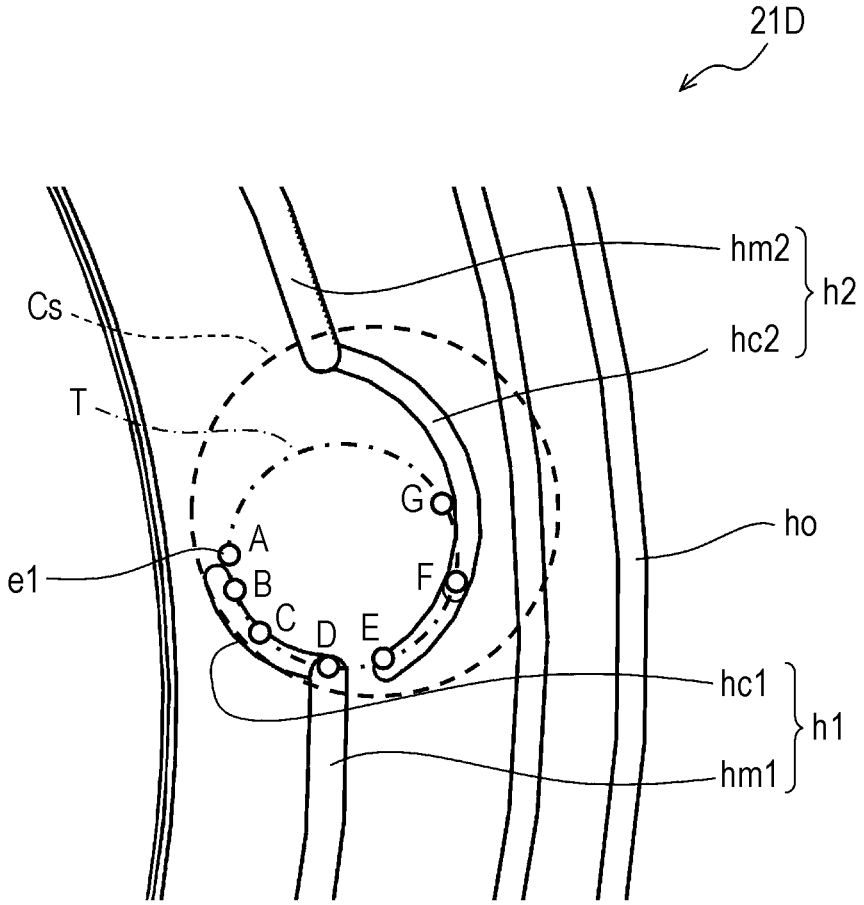
FIG. 11 is a partially-enlarged view of a movement trajectory of an oil supply hole at a lower surface of a fixed scroll provided in a scroll compressor according to a fifth embodiment.

FIG. 11 is a partially-enlarged view of a movement trajectory T of the opening e1 of the oil supply hole hg (not shown in FIG. 11, see FIG. 2) at a lower surface of a fixed scroll 21D provided in the scroll compressor according to the fifth embodiment.

As a crank angle of the scroll compressor increases, the opening e1 of the oil supply hole hg moves counterclockwise in FIG. 11 in the order of positions A, B, C, D, E, F, G. Moreover, the first control groove hc1 and a second control groove hc2 are provided in an arc shape to partially overlap with the movement trajectory T of the opening e1 of the oil supply hole hg.

A first groove h1 is provided such that the overlapping area between the opening e1 of the oil supply hole hg and the first groove h1 (in FIG. 11, the first control groove hc1) monotonically increases during swing of a swing scroll 22 (see FIG. 1) as indicated by the positions B, C, D of FIG. 11. With this configuration, a rapid increase in the pressure of a first oil groove hm1 at a moment that the oil supply hole hg communicates with the first control groove hc1 can be reduced.

Note that as in the first control groove hc1, the same also applies to the second control groove hc2. That is, a second groove h2 is provided such that an overlapping area between the opening e1 of the oil supply hole hg and the second groove h2 (in FIG. 11, the second control groove hc2) monotonically increases during swing of the swing scroll 22 (see FIG. 1) as indicated by the positions E, F of FIG. 11. With this configuration, a rapid increase in the pressure of a second oil groove hm2 at a moment that the oil supply hole hg communicates with the second control groove hc2 can be reduced.

Note that as illustrated in FIG. 11, the first control groove hc1 is preferably in an arc shape forming part of a predetermined circle Cs having a greater diameter than that of the circular movement trajectory T upon movement of the opening e1. Similarly, the second control groove hc2 is preferably in an arc shape forming part of the predetermined circle having the greater diameter than that of the circular movement trajectory T upon movement of the opening e1. According to such a configuration, the positions of the first control groove hc1 and the second control groove hc2 in a circumferential direction are set as necessary so that, e.g., the overlapping area between the opening e1 and the first control groove hc1 can be gradually increased in the course of starting, e.g., communication of the opening e1 with the first control groove hc1.

Advantageous Effects

According to the fifth embodiment, rapid thrust load fluctuation accompanied by a supply of high-pressure lubricant oil can be reduced. As a result, abrasion and sealability degradation due to an uneven end plate surface pressure of the swing scroll 22 can be reduced. Thus, the performance and reliability of the scroll compressor can be further enhanced as compared to the first embodiment.

Sixth Embodiment

In a sixth embodiment, an air-conditioner W (a refrigeration cycle device: see FIG. 12) including a scroll compressor 100 (see FIG. 1) described in the first embodiment will be described.

Figure 12:
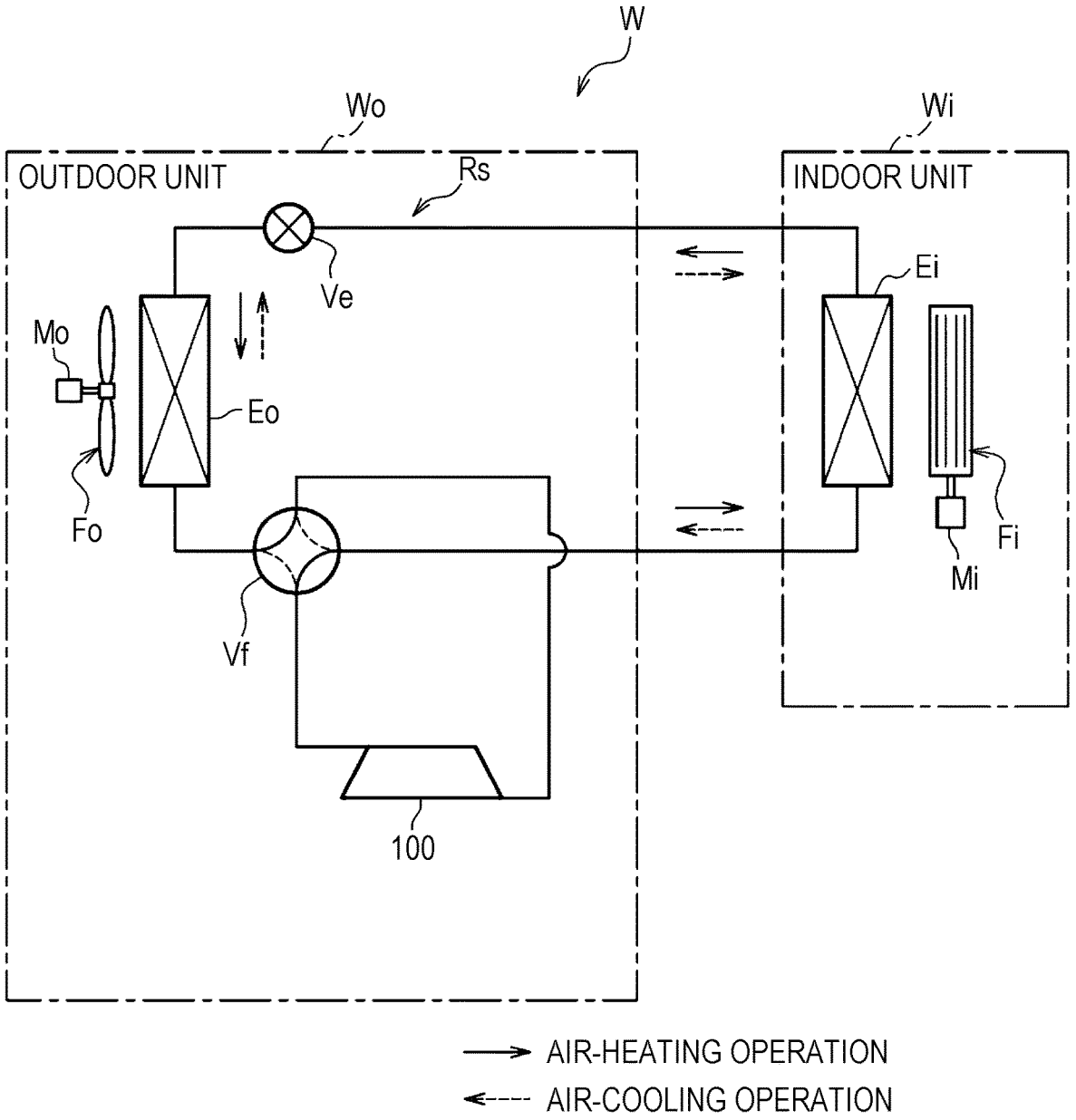
FIG. 12 is a configuration diagram of a refrigerant circuit of an air-conditioner according to a sixth embodiment.

FIG. 12 is a configuration diagram of a refrigerant circuit Rs of the air-conditioner W according to the sixth embodiment.

Note that solid arrows in FIG. 12 indicate the flow of refrigerant in air-heating operation.

On the other hand, dashed arrows in FIG. 12 indicate the flow of refrigerant in air-cooling operation.

The air-conditioner W is equipment configured to perform air-conditioning such as air heating and air cooling.

As illustrated in FIG. 12, the air-conditioner W includes the scroll compressor 100, an outdoor heat exchanger Eo, an outdoor fan Fo, an expansion valve Ve, a four-way valve Vf, an indoor heat exchanger Ei, and an indoor fan Fi.

In an example of FIG. 12, the scroll compressor 100, the outdoor heat exchanger Eo, the outdoor fan Fo, the expansion valve Ve, and the four-way valve Vf are provided in an outdoor unit Wo. On the other hand, the indoor heat exchanger Ei and the indoor fan Fi are provided in an indoor unit Wi.

The scroll compressor 100 is equipment configured to compress refrigerant in a gas form. The scroll compressor 100 includes a configuration similar to that of the first embodiment (see FIG. 1).

In the outdoor heat exchanger Eo, heat exchange between refrigerant flowing in a heat transfer pipe (not shown) of the outdoor heat exchanger Eo and external air sent from the outdoor fan Fo is performed.

The outdoor fan Fo sends the external air to the outdoor heat exchanger Eo. The outdoor fan Fo includes an outdoor fan motor Mo as a drive source, and is placed in the vicinity of the outdoor heat exchanger Eo.

In the indoor heat exchanger Ei, heat exchange between refrigerant flowing in a heat transfer pipe (not shown) of the indoor heat exchanger Ei and indoor air (air in an air-conditioning target space) sent from the indoor fan Fi is performed.

The indoor fan Fi sends the indoor air to the indoor heat exchanger Ei. The indoor fan Fi includes an indoor fan motor Mi as a drive source, and is placed in the vicinity of the indoor heat exchanger Ei.

The expansion valve Ve depressurizes refrigerant condensed in a "condenser" (one of the outdoor heat exchanger Eo or the indoor heat exchanger Ei). Note that the refrigerant depressurized by the expansion valve Ve is guided to an "evaporator" (the other one of the outdoor heat exchanger Eo or the indoor heat exchanger Ei).

The four-way valve Vf switches a refrigerant flow path according to an operation mode of the air-conditioner W. For example, in the refrigerant circuit Rs in the air-cooling operation (see the dashed arrows in FIG. 12), the scroll compressor 100, the outdoor heat exchanger Eo (the condenser), the expansion valve Ve, and the indoor heat exchanger Ei (the evaporator) are sequentially connected to each other through the four-way valve Vf. In the air-cooling operation, refrigerant circulates in a refrigeration cycle in the refrigerant circuit Rs.

On the other hand, in the refrigerant circuit Rs in the air-heating operation (see the solid arrows in FIG. 12), the scroll compressor 100, the indoor heat exchanger Ei (the condenser), the expansion valve Ve, and the outdoor heat exchanger Eo (the evaporator) are sequentially connected to each other through the four-way valve Vf. In the air-heating operation, refrigerant circulates in the refrigeration cycle in the refrigerant circuit Rs.

As described above, in the sixth embodiment, in the refrigerant circuit Rs, refrigerant sequentially circulates through the scroll compressor 100, the "condenser," the expansion valve Ve, and the "evaporator."

Advantageous Effects

According to the sixth embodiment, the air-conditioner W includes the scroll compressor 100 of which manufacturing cost is low and of which performance and reliability are high. Thus, a cost for manufacturing the entirety of the air-conditioner W can be reduced, and the performance and reliability of the air-conditioner W can be enhanced.

<<Variations>>

The scroll compressor 100 and the air-conditioner W according to one aspect of the present disclosure have been described above with reference to each embodiment. The aspect of the present disclosure is not limited to such description. Various changes can be made to these embodiments.

For example, in the configuration described in each embodiment, the first control groove hc1 (see FIG. 3) and the second control groove hc2 (see FIG. 3) are in the arc shape. However, the shapes of the first control groove hc1 and the second control groove hc2 are not limited to the arc shape. That is, as long as the shape of the first control groove hc1 or the second control groove hc2 is the shape including part of the movement trajectory T of the opening e1 of the oil supply hole hg, such a shape may be other shapes (e.g., a polygonal line shape or a straight line shape).

Moreover, in the configuration described in each embodiment, the first oil groove hm1 is connected to one end of the first control groove hc1 (see FIG. 3). However, the first oil groove hm1 may be connected to other locations. For example, the first oil groove hm1 may be connected to a predetermined location of the first control groove hc1 in the arc shape, other than both ends of the first control groove hc1. Note that the same also applies to the second control groove hc2 and the second oil groove hm2.

Further, in the configuration described in each embodiment, the first groove h1 (see FIG. 3) includes the first control groove hc1 and the first oil groove hm1. On this point, the first control groove hc1 may be omitted from the first groove h1, and one end of the arc-shaped first oil groove hm1 may overlap with part of the movement trajectory T of the opening e1. Similarly, the second control groove hc2 may be omitted from the second groove h2 (see FIG. 3), and one end of the arc-shaped second oil groove hm2 may overlap with part of the movement trajectory T of the opening e1. In such a configuration, part of the arc-shaped first oil groove hm1 and part of the arc-shaped second oil groove hm2 may overlap with each other in the radial direction.

In addition, in the configuration described in each embodiment, the first oil discharge groove hn1 and the second oil discharge groove hn2 are provided at the end plate surface 21*f* of the fixed scroll 21 (see FIG. 3). On this point, the first oil discharge groove hn1 and/or the second oil discharge groove hn2 may be omitted. A reason is that even in the case of providing no first oil discharge groove hn1, the lubricant oil having flowed out of the first groove h1 flows out through the clearance between the end plate surface 21*f* of the fixed scroll 21 and the end plate surface 22*f* of the swing scroll 22, for example.

Moreover, in the configuration described in each embodiment, the annular outer peripheral groove ho is provided at the end plate surface 21*f* of the fixed scroll 21 (see FIG. 3). On this point, the outer peripheral groove ho may be omitted, and the first oil discharge groove hn1 and the second oil discharge groove hn2 may communicate with the back pressure chamber Sb (see FIG. 2) through outer end portions of the first oil discharge groove hn1 and the second oil discharge groove hn2 in the radial direction, for example.

Further, in the configuration described in the first embodiment, the number of openings e1 provided at the end plate surface 22*f* of the swing scroll 22 (see FIG. 2) is one. However, the number of openings to be provided is not limited to one. For example, another opening (an opening for guiding the lubricant oil from the oil supply hole hg: not shown) may be provided on the opposite side of the axis Z of the crankshaft 3 from the opening e1. In such a configuration, a first groove (not shown) and/or a second groove (not shown) may be additionally provided to pass part of a movement trajectory of another opening. Even in this configuration, each opening e1 (i.e., the same opening e1) can alternately communicate with the first groove h1 and the second groove h2 along with swing of the swing scroll 22. Thus, in this configuration, advantageous effects similar to those of the first embodiment are provided.

The embodiments can be combined as necessary. For example, the second embodiment and the fourth embodiment can be combined together. In this case, the fixed scroll 21A may include the first oil discharge groove hA1 and the second oil discharge groove hA2 (the second embodiment: see FIG. 8), for example. Further, the depth H1 of the first control groove hc1 may be smaller than the depth H2 of the first oil groove hm1 (the fourth embodiment: see FIG. 10).

For example, the third embodiment and the sixth embodiment can be combined together. In this case, the air-conditioner W (the sixth embodiment: see FIG. 12) may include the scroll compressor (see FIG. 9) having the configuration described in the third embodiment. In addition, various combinations can be made.

The air-conditioner W (see FIG. 13) described in the sixth embodiment can be applied to various types of air-conditioners such as a room air-conditioner, a package air-conditioner, and a building multi-type air-conditioner. In the sixth embodiment, the air-conditioner W (the refrigeration cycle device: see FIG. 9) including the scroll compressor 100 has been described. The sixth embodiment is not limited to the air-conditioner, and can be also applied to other "refrigeration cycle devices" such as a freezer, a hot water supply machine, an air-conditioning hot water supply device, a chiller, and a refrigerator.

In each embodiment, the case where refrigerant is compressed by the scroll compressor 100 has been described. On this point, each embodiment can be also applied to a case where predetermined gas other than refrigerant is compressed by the scroll compressor 100.

For clearly describing the technique of the present disclosure, each embodiment has been described in detail. The technique of the present disclosure is not limited to one including all configurations described in each embodiment. Moreover, some of the configurations of each embodiment can be, as necessary, omitted or replaced with other configurations. Further, other configurations can be, as necessary, added to the configurations of the embodiments and the like.

Each embodiment described above has described the mechanisms and the configurations considered as necessary for description. Each embodiment does not necessarily describe all mechanisms and configurations in a product.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A scroll compressor comprising:

a hermetic container;

a fixed scroll including a spiral fixed wrap and fixed to an inside of the hermetic container;

a swing scroll including a spiral swing wrap forming, together with the fixed wrap, a compression chamber;

a frame configured to support the swing scroll;

an electric motor including a stator and a rotor; and a shaft including a through-hole for guiding lubricant oil and configured to rotate integrally with the rotor, wherein a first groove and a second groove are provided outside the fixed wrap in a radial direction at an end plate surface of the fixed scroll, wherein the first groove is a first arc shape extending less than 360° about an axis of the shaft at the end plate surface of the fixed scroll, wherein the second groove is a second arc shape extending less than 360° about the axis of the shaft, the second arc shape being shifted from the first arc shape in a circumferential direction by a predetermined amount, wherein an oil supply hole for guiding the lubricant oil from the through-hole opens at an end plate surface of the swing scroll, and wherein a single opening of the oil supply hole alternately communicates with the first groove and the second groove along with swing of the swing scroll, wherein a part of the first groove where the single opening of the oil supply hole communicates with the first groove extends inwardly toward the fixed wrap in the radial direction, and wherein a part of the second groove where the single opening of the oil supply hole communicates with the second groove extends outwardly away from the fixed wrap in the radial direction.

2. The scroll compressor according to claim 1, wherein the part of the first groove where the single opening of the oil supply hole communicates with the first groove is a first control groove, wherein the part of the second groove where the single opening of the oil supply hole communicates with the second groove is a second control groove, and wherein the axis of the shaft, the first control groove, and the second control groove partially overlap with each other in the radial direction.

3. The scroll compressor according to claim 2, wherein a depth of the first control groove is smaller than a depth of the first oil groove, and wherein a depth of the second control groove is smaller than a depth of the second oil groove.

4. The scroll compressor according to claim 2, wherein the first control groove and the second control groove are in arc shapes forming part of a predetermined circle having a greater diameter than that of a circular movement trajectory of the opening of the oil supply hole at the end plate surface of the fixed scroll.

5. The scroll compressor according to claim 1, wherein when a crank angle of the swing scroll is a high thrust load angle upon swing of the swing scroll, the opening of the oil supply hole passes at least part of a predetermined offset load region, the high thrust load angle is a predetermined crank angle advanced from a crank angle at a start of discharging of gas from the compression chamber by 180°, and the predetermined offset load region is a region forming an angle of equal to or greater than 90° and equal to or less than 180° with respect to a direction of rotation of the shaft with reference to an eccentric direction of the swing scroll.

6. The scroll compressor according to claim 1, wherein a center angle of the first arc shape of the first groove and a center angle of the second arc shape of the second groove are equal to or less than 180°.

7. The scroll compressor according to claim 1, wherein an annular outer peripheral groove communicating with a back pressure chamber of the frame is provided in a vicinity of a peripheral edge of the end plate surface of the fixed scroll, and wherein at the end plate surface of the fixed scroll, a first oil discharge groove causing the first groove and the outer peripheral groove to communicate with each other and a second oil discharge groove causing the second groove and the outer peripheral groove to communicate with each other are provided.

8. The scroll compressor according to claim 1, wherein the first groove is provided such that an overlapping area between the opening of the oil supply hole and the first groove monotonically increases during swing of the swing scroll.

9. A refrigeration cycle device comprising:

a refrigerant circuit including the scroll compressor according to claim 1, a condenser, an expansion valve, and an evaporator, wherein in the refrigerant circuit, refrigerant circulates sequentially through the scroll compressor, the condenser, the expansion valve, and the evaporator.

* * * * *